US009518483B2

(12) United States Patent
Jones

(10) Patent No.: US 9,518,483 B2
(45) Date of Patent: Dec. 13, 2016

(54) CAM ROCKER LEVER FOR OPERATING VALVES

(71) Applicant: Cummins Inc., Columbus, IN (US)

(72) Inventor: John Peter Jones, Windermere, FL (US)

(73) Assignee: CUMMINS INC., Columbus, IN (US)

( * ) Notice: Subject to any disclaimer, the term of this patent is extended or adjusted under 35 U.S.C. 154(b) by 0 days.

(21) Appl. No.: 14/753,739

(22) Filed: Jun. 29, 2015

(65) Prior Publication Data

US 2015/0377081 A1 Dec. 31, 2015

(30) Foreign Application Priority Data

Jun. 30, 2014 (IN) ..... 3161/CHE/2014

(51) Int. Cl.

| | |
|---|---|
| ***F01L 1/18*** | (2006.01) |
| ***F01L 1/047*** | (2006.01) |
| ***F01L 1/02*** | (2006.01) |
| ***F01L 1/30*** | (2006.01) |

(52) U.S. Cl.

CPC ..... *F01L 1/18* (2013.01); *F01L 1/026* (2013.01); *F01L 1/047* (2013.01); *F01L 1/185* (2013.01); *F01L 1/30* (2013.01)

(58) Field of Classification Search

CPC ..... F01L 1/047; F01L 1/18; F01L 1/185; F01L 1/30

USPC ..... 123/90.39, 90.44

See application file for complete search history.

(56) References Cited

U.S. PATENT DOCUMENTS

| | | | | |
|---|---|---|---|---|
| 3,578,024 | A | 5/1971 | Hill | |
| 4,245,953 | A | 1/1981 | Milton et al. | |
| 4,957,073 | A | 9/1990 | Bergeron | |
| 5,170,766 | A | 12/1992 | Haas et al. | |
| 6,539,909 | B2 | 4/2003 | Yager | |
| 8,061,315 | B2 * | 11/2011 | Nakamura | F01L 1/12 123/90.16 |
| 8,109,737 | B1 | 2/2012 | Gamble et al. | |
| 8,336,852 | B1 | 12/2012 | Lahousse et al. | |

* cited by examiner

*Primary Examiner* — Ching Chang
(74) *Attorney, Agent, or Firm* — Foley & Lardner LLP

(57) ABSTRACT

A cam rocker lever comprises an annular piece with an inner diameter, a cam lobe, a first linear portion, and a second linear portion. The cam lobe is disposed within the inner diameter of the annular piece. The first linear portion extends from a first side of the annular piece, and a second linear portion extends from a second side of the annular piece opposite the first side. The first linear portion is configured to connect to a stem of a valve such that the valve is displaced when the first linear portion is displaced.

14 Claims, 5 Drawing Sheets

CAM ROCKER LEVER FOR OPERATING VALVES

CROSS-REFERENCE TO RELATED APPLICATIONS

This application claims priority to Indian Provisional Patent Application No. 3161/CHE/2014, filed Jun. 30, 2014 and entitled "Intake and Exhaust Valve Cartridge", the entire disclosure of which is incorporated by reference herein.

TECHNICAL FIELD

The present disclosure relates generally to intake and exhaust valves for engine cylinders.

BACKGROUND

Engine valves are typically used in combustion engines to control timing and quantity aspects of gas, air, or vapor flow into and out of the engine cylinder. Engine valves may come in the form of a variety of intake engine valves and exhaust engine valves. Intake engine valves control the intake of gas, air, or vapor flowing into the cylinder of an engine by opening and closing depending upon the cylinder cycle. Conversely, exhaust engine valves facilitate parameters of gas, air, or vapors exiting the combustion cylinder of an engine by opening and closing accordingly.

Conventional engine systems require the use of several separate parts, along with the engine valves, to coordinate intake and exhaust functions of the machine. The separate parts include valve seats, valve seat inserts, valve guides, valve springs, valve spring retainers, separate port throats, etc. Many of the individual parts are subject to damage from heat application and require service. For example, the valve seat insert, which serves as a seal between the head of a valve and the surface upon which a valve head may sit, often receives a great amount of heat and may warp, bend, crack, loosen, separate, or corrode with extended use. Similarly, the valve seat may experience warping, bending, cracking, loosening, or corrosion from heat exiting the cylinder. The resistance of the parts above to heat application, for example, may affect cylinder pressure capabilities, which may in turn increase the efficiency and operational abilities of an engine as a whole.

SUMMARY

Various embodiments relate to a cartridge apparatus for an engine. The cartridge apparatus comprises a single piece component, which includes a valve seat, a valve guide, and a lower port throat. The valve seat is configured to connect with a head of a valve and is located at an end of the valve guide. Additionally, the valve guide is configured to accept a stem of the valve. The lower port throat is disposed within the single piece component and is configured to receive a flow of material. The upper external region in the cartridge is configured to fasten the cartridge to the cylinder head Another embodiment relates to a cam rocker lever. The cam rocker lever comprises an annular piece with an inner diameter, a cam lobe, a first linear portion, and a second linear portion. The cam lobe is disposed within the inner diameter of the annular piece. The first linear portion extends from a first side of the annular piece, and a second linear portion extends from a second side of the annular piece opposite the first side. The first linear portion is configured to connect to a stem of a valve such that the valve is displaced when the first linear portion is displaced.

BRIEF DESCRIPTION OF THE DRAWINGS

The details of one or more implementations of the subject matter described in this specification are set forth in the accompanying drawings and the description below. Other features and aspects of the subject matter will become apparent from the description, the drawings, and the claims presented herein.

DETAILED DESCRIPTION OF VARIOUS EMBODIMENTS

The apparatus and systems below describes a single piece cartridge for use in an engine system. The single piece cartridge (also referred to as a valve cartridge and cartridge throughout the disclosure) combines several components for valve use within an engine. The cartridge combines a valve seat, a valve guide, and a lower port throat. The components are cast into a single piece component, which is insertable into various parts of an engine. Such a cartridge may replace the need for a traditional valve seat insert and separate valve guide. In some embodiments, the single piece component is cast into a cylinder head, further reducing the number of separate parts in an engine. The single piece cartridge provides a greater distribution of heat dissipation between elements of the cartridge and valve components, which in turn may allow for higher peak cylinder pressure operating capabilities.

Various embodiments provided herein allow for modification of engine displacement without modifying the engine rod or piston. Changes in displacement may require either increasing or decreasing the bore and stroke. In particular, changes in stroke can require a new crankshaft and revised connecting rods and/or pistons. Various embodiments described herein involve machining of the crankcase to accommodate differences in stroke length, while keeping the engine rod and piston the same. A simpler and more efficient manufacturing, machining, and assembling engine components may be recognized. Additionally, in the case of potential field surface, the implementation of various embodiments described herein result in easier disassembly and reassembly, without the need for special tools.

A cam rocker lever configured to facilitate the opening and closing of a valve is also described. The cam rocker lever comprises an annular piece having a cam lobe disposed within an inner portion of the annual piece. The annular piece has a first linear portion extending from one side of the annular piece, wherein the portion is configured to communicate with a valve stem. The annular piece also has a second linear portion extending opposite the side of the first linear portion. When the second linear portion is displaced, the first linear portion is also displaced, in turn displacing the valve.

Figure 2A:
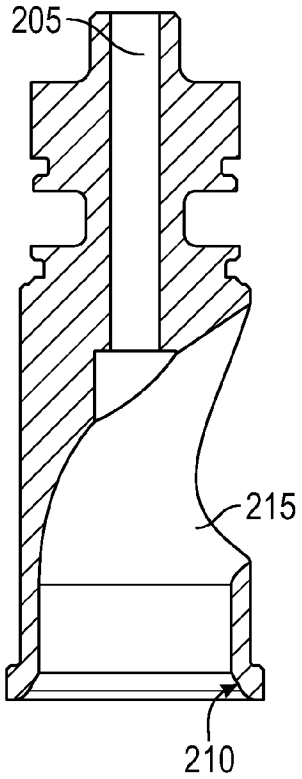
FIG. 2A is a cross-sectional view of the valve cartridge of FIG. 1.
Figure 1:
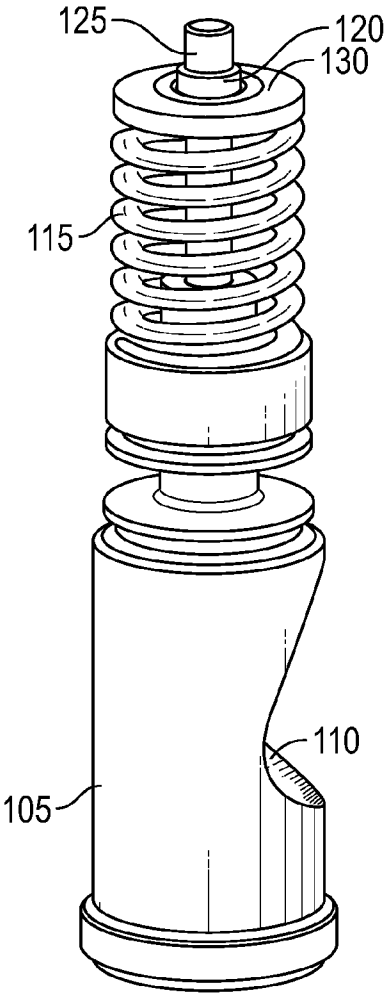
FIG. 1 is a perspective view of a valve cartridge with valve components constructed according to one embodiment.

Referring to FIG. 1, a perspective view of a valve cartridge 105 having valve components coupled to the valve cartridge 105 is shown. The valve cartridge 105 has several components, including a valve cartridge 105, a cartridge side opening 110, a valve spring 115, a valve collet 120, a valve 125, and a spring retainer 130. The valve cartridge 105 is configured to be communicatively coupled to an engine cylinder to receive material such as air and fuel or release material such as combustion exhaust. The valve cartridge 105 is also configured to connect to the cylinder head of an engine system by being inserted into a bore within the cylinder head. In one embodiment, the valve cartridge 105 is made of sintered powered metal or structural ceramic. A cross-sectional view of the valve cartridge 105 of FIG. 1 is shown in FIG. 2A. The valve cartridge 105 contains cast sections on the inner portion of the valve cartridge 105 that includes a valve guide 205, a valve seat 210, and a lower port throat 215. The valve guide 205 is configured to accept a portion of the valve (i.e., the stem) within the interior of the valve cartridge 105. The valve guide 205 accepts the valve stem and positions the valve such that portions of the valve (i.e., the head) make contact with the valve seat 210 on the valve cartridge 105. The valve guide 205 may vary in length based on the type of valves used in an engine. The diameter of the valve guide 205 is greater than the diameter of the valve stem to allow room for the valve stem to move within the valve guide 205.

The valve seat 210 is located on an edge wall of the valve cartridge 105 at the end of the valve cartridge 105 and is configured to communicatively couple to an engine cylinder. The valve seat 210 serves as a resting surface for the valve 125 when the valve 125 is in a closed position. The valve seat 210 facilitates proper efficiency and operation of the engine by preventing leakage when the valve 125 is closed. The valve seat 210 in the valve cartridge 105 also receives heat from the cylinders during combustion cycles, and the heat dissipates throughout the entire housing of the valve cartridge 105, thus allowing for cooler temperatures. The increased surface contact area between the valve seat 210, the lower port throat 215, and the valve stem bore region reduces the valve seat temperatures and combustion temperatures at the face of the valve cartridge 105. Heat dissipation is also more evenly distributed among the components. This allows for increased combustion capabilities and therefore increased engine operability.

The lower port throat 215 is disposed within the valve cartridge 105 and is configured to receive and position objects within the valve cartridge 105. In one embodiment, the lower port throat 215 receives portions of an intake manifold/port or an exhaust manifold/port. The lower port throat 215 facilitates the flow of material, such as air, exhaust, air/fuel mixture, etc., into and out of the valve cartridge 105 and engine cylinders connected to the valve cartridge 105. In some embodiments, the flow of material throughout the port may be controlled or tuned. For example, cast swirl vanes may be added to the interior walls of the lower port throat 215 to increase and redirect flow entry into the cylinder bore. The plurality, size, spacing, and direction of the swirl vanes may be altered accordingly to control the flow. For example, the swirl vanes may comprise of tightly coiled thin vanes or loosely coiled thicker vanes. The flow characteristics may also be controlled by adding variations to the wall surface of the lower port throat, such as grooves, radial bumps, protrusions, etc. In other embodiments, the flow characteristics are controlled via tumble flow conditions by varying the size of the cast ports used in relation to the size of the lower port throat. The lower port throat 215 designs are configured to be designed such that a customized flow individually matches engine requirements for different types of engines, including gas, diesel, alternate fuel, etc.

Figure 2B:
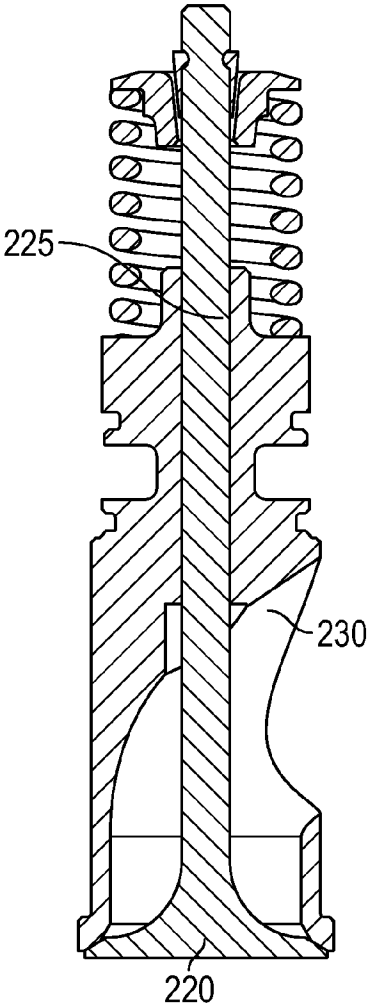
FIG. 2B is a cross-sectional view of the valve cartridge with valve components of FIG. 1.

Referring again to FIG. 1, a cartridge side opening 110 is shown. The cartridge side opening 110 is an opening on the side of the valve cartridge 105 that allows for a flow of material and/or an object to be received into the interior of the valve cartridge 105. The cartridge side opening 110 may be connected to the lower port throat 215 within the valve cartridge 105 as shown in FIG. 2B. The cartridge side opening 110 is configured to accept an intake port and/or an exhaust port on an engine. In some embodiments, the cartridge side opening 110 is larger than an intake port or exhaust port on an engine, which allows the intake port or the exhaust port to be inserted within the cartridge side opening 110. The insertion of the intake port or exhaust port into the cartridge side opening 110 allows materials such as air, oil, combustion exhaust, etc., to flow into the valve cartridge 105 towards the engine cylinder during intake engine cycles and outward away from the cylinders during exhaust engine cycles. In embodiments where an intake port is used, the engine system may have an air flow path wherein air flows through a turbo, a crossover, the intake manifold, the cylinder head (or combined cylinder and head) port, and the valve cartridge 105.

The valve 125 is a device that regulates the flow of material based on its positioning within a unit. For example, a valve 125 in an open position may allow material to flow at adjustable rates while a valve 125 in a closed position may fully or partially obstruct the flow. FIG. 2B shows a valve 125 positioned within a valve cartridge 105. The valve 125 has a valve head 220 at one end thereof. The valve head 220 is configured to sit on the valve seat 210 to create a seal when the valve 125 is in a closed position. When the valve head 220 is displaced from the valve seat 210, the valve seat is in an open position, which allows material to enter or exit the valve cartridge 105 during engine cycles. The valve stem 225 of the valve 125 is also shown in FIG. 2B extending opposite the valve head 220 and protruding outside the valve cartridge 105 toward the end of the valve cartridge 105 connectable to a cylinder head.

The valve spring 115 is positioned on an upper portion of the exterior of the valve cartridge 105 and is communicatively connected to the valve stem 225 of the valve 125 through the spring retainer 130. The valve spring 115 facilitates the movement of the valves 125 using the spring force properties of the spring. The spring retainer 130 surrounds the valve 125 and transfers the spring force from the valve spring 115 to the valve 125. The spring retainer 130 also provides a surface that holds the valve spring 115 in place and allows the valve spring 115 to compress during cycles of an engine. The spring retainer 130 is located above the valve spring 115 near the end of the valve stem 225.

FIG. 1 also shows a valve collet 120 on the valve 125. The valve collet 120 surrounds the valve 125 and may be positioned between the valve 125 and the spring retainer 130. The valve collet 120 serves as a locking collar for the valve 125 and the valve cartridge 105. When force is exerted onto the spring retainer 130 by the valve spring 115, the valve collet 120 securely locks the valve 125 into place so that the valve 125 may open and close securely during engine operation. The valve collet 120 may eliminate the need for a traditional valve seat insert into the valve seat 210, which often causes loosening and separation problems.

Figure 3:
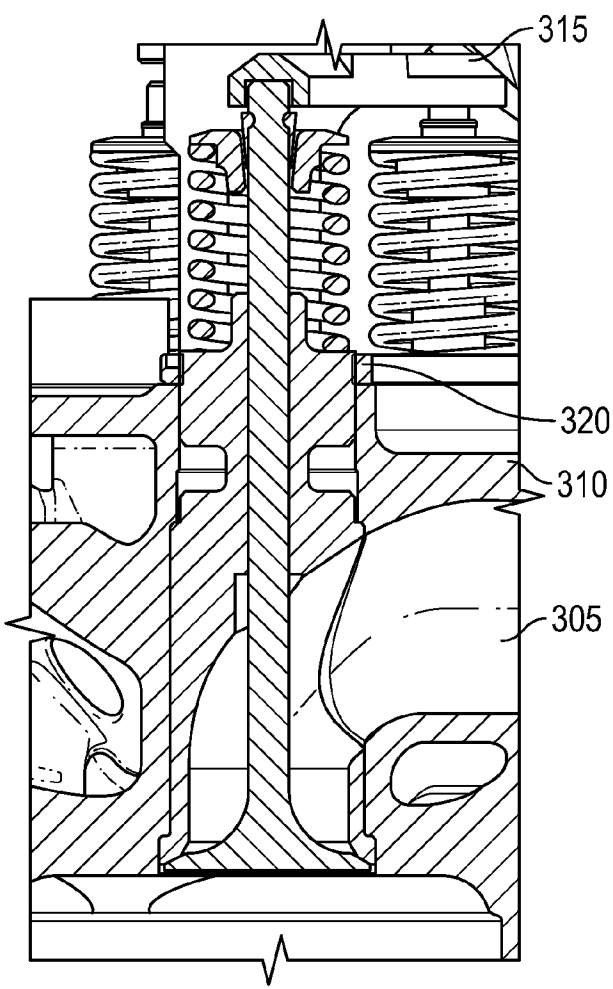
FIG. 3 is a cross-sectional view of the valve cartridge and valve components when positioned within in a cylinder head.

Referring to FIG. 3, a cross-sectional view of the valve cartridge 105 and valve components when positioned within in a cylinder head 310 is shown. The valve cartridge 105 may be inserted into a recess in the engine from within the cylinder and subsequently tightened by the valve collet 120. The valve head 220 is shown in a closed position proximate the cylinder bore. A port 305 is disposed within the lower port throat of the valve cartridge 105. The port 305 may be an intake port or an exhaust port. An intake port may be connected to an intake manifold, which intakes material into the engine. The exhaust port may be connected to an exhaust manifold, which facilitates exiting of combustion exhaust from the engine cylinder. The cylinder head 310 surrounds the valve cartridge 105 and the sits on top of the cylinder, connecting the valve cartridge 105 to the cylinder. The portion of the valve stem 225 shown protruding past the valve collet 120 is shown attached to a portion of a cam rocker lever. FIG. 3 also displays a plurality of valve cartridges 105 and valve components positioned in the cylinder head 310. In some embodiments, the valve cartridge 105 may be easily manufactured with valve components, such as the valve 125, the valve spring 115, seal parts, etc., preassembled within the valve cartridge 105. The valve cartridge 105 also improves the engine build assembly process and field re-work processes. For example, the valve cartridge 105 reduces the amount of parts needed to be built, assembled, maintained, and/or replaced over the lifespan of the engine.

Figure 7:
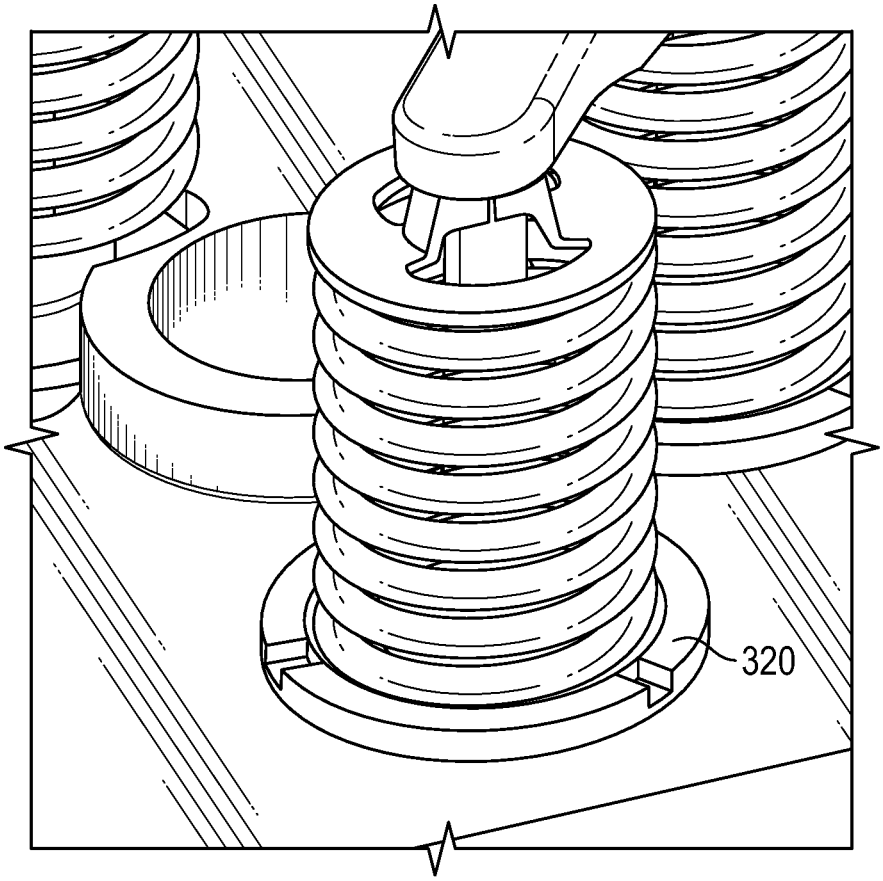
FIG. 7 is a schematic view of a valve cartridge fastened to a cylinder head using valve cartridge retention rings.

According to some embodiments, the valve cartridge 105 may contain a valve cartridge retention ring 320. The valve cartridge retention ring 320 acts as a fastener to secure the valve cartridge 105 to the cylinder head 310. The valve cartridge retention ring 320 also secures the valve cartridge 105 to the combined head and cylinder component 405 of FIG. 4. For example, the valve cartridge retention ring 320 may secure the valve cartridge 105 on to a top face of the upper most deck in the combined head and cylinder component 405. The valve cartridge 105 is configured with external threading on portions of the housing body to fasten the ring from the top. As shown in FIG. 7, the valve cartridge retention ring 320 has features to torque the rings and preload the valve cartridge 105 body between a valve counter bore and a retention location within the combined cylinder head component 405. This positive attachment not only secures the valve cartridge 105 to the combined head and cylinder component 405, but also provides positive connection and redundancy against any valve cartridge 105 drop in case of loss of radial press fit, which may result from tolerance issues, assembly, adverse thermal affects/relaxation, and other elements. The preload provides required sealing against materials such as gas and fluids at the location in which the valve cartridge 105 and the combined head and cylinder component 405 interfaces and also metal to metal surface contact to improve cooling. The additional redundancy in the valve cartridge retention ring 320 facilitates decreased radial interference in the valve counter bore as compared with conventional valve seat inserts. According to some embodiments, lesser interference results in reduced assembly force needed to push the valve cartridge 105 into the combined cylinder head component 405. In other embodiments, the valve cartridge retainer ring 320 (as shown in FIG. 7) is configured with features to torque the valve cartridge 105 the top. This arrangement facilitates servicing and assembly several components described herein.

Figure 4:
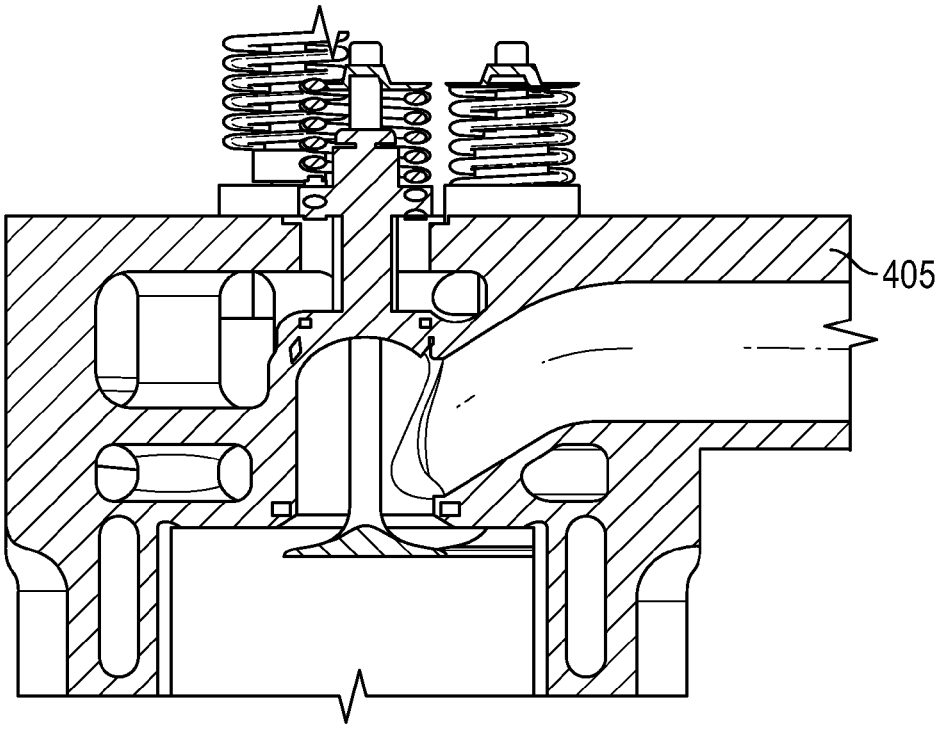
FIG. 4 is a cross-sectional view of a combined valve cartridge and combined cylinder head component constructed according to a particular embodiment.

In other embodiments, the valve cartridge 105 may be combined in a combined head and cylinder component 405 as shown in FIG. 4. The combined head and cylinder component 405 provides for a single cast piece for the cylinder chambers and the cylinder head. It facilitates intake and exhaust functions and also allows for intake and exhaust port optimization to improve engine breathing. In some embodiments, the intake ports and/or exhaust ports on the combined head and cylinder component 405 are sleeved, wherein in other embodiments, the intake ports and/or exhaust ports are not sleeved. In one embodiment, the valve cartridge 105 is cast into the structure of the combined head and cylinder component 405. For example, the valve seat, the valve guide and the valve stem bore, and the lower port throat is constructed from the walls of the combined head and cylinder component 405. In one example, the valve seat abuttedly faces the cylinder in the engine. Heat created from combustion within the cylinder is dissipated not only through the valve seat but also throughout the various surfaces of the combined head and cylinder component 405. The greater the area that heat may dissipate in parts of the engine, the cooler the overall engine temperatures. Thus, the increased heat dissipation across the larger surface area of the combined head and cylinder component 405 causes the engine to experience cooler temperatures, which may increase the operational abilities of the engine. In some embodiments, ports on the combined head cylinder 405 may be insulated to further regulate temperature.

The combined head and cylinder component 405 provides for a stiffer cylinder head and improved peak cylinder pressure limits. In particular embodiments, higher peak cylinder pressures may be achieved using, for example, low grade grey iron castings. Higher grade materials, such as compacted graphite iron, may also be used to achieve high cylinder pressures. In other embodiments, the structures discussed herein may also be produced in aluminum to achieve structural and packaging efficiency. The valve cartridge 105 and valve components assembled within the combined head and cylinder component 405 also structurally stiffens the cylinder head structures, thus providing increased strength. In some examples, a dry liner may be used in the combined head and cylinder component 405 to facilitate the combustion in a combustion engine. The dry liner may be inserted into a blind cylinder bore. The relationship of the dry liner to the blind cylinder bore upper radius is at 5:6 mm in one example, which protects the piston top ring and maintains the capability to carry high cylinder pressure loads. In some embodiments, the dry liner may facilitate ease of service rework. The dry liner may also provide sealing for oil pockets in the combined cylinder head and contribute to structural strength.

Figure 6:
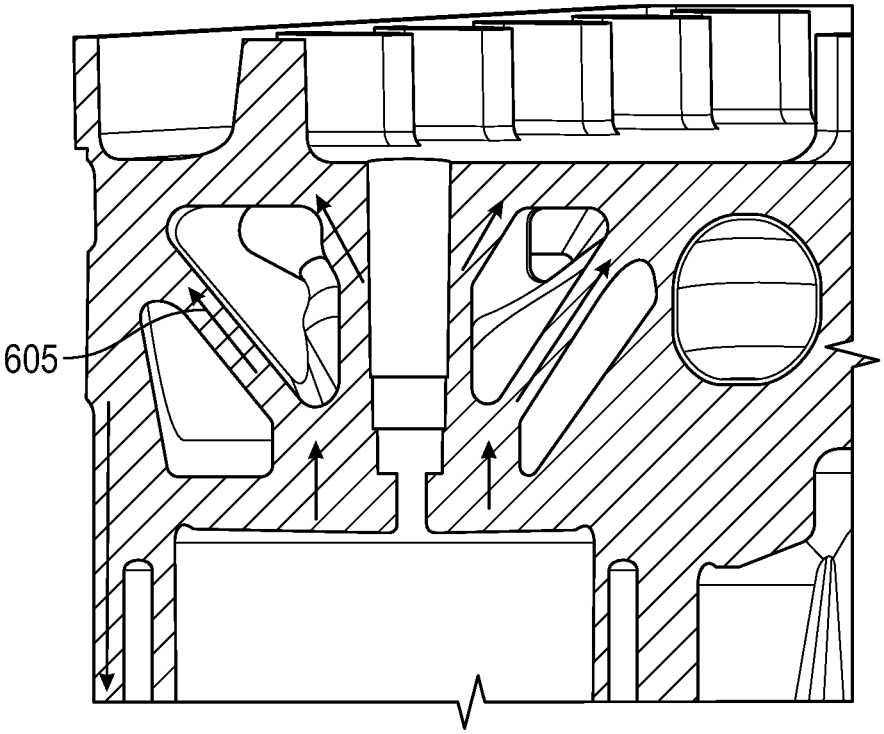
FIG. 6 is a schematic view of an exemplary cylinder head with angled cast walls for use in stress reduction.

In some embodiments, the combined head and cylinder component 405 includes angled cast walls, which also improve the strength and stability of the combined head and cylinder component 405 by controlling and pressure loading. Referring to FIG. 6, a schematic view of a cylinder head with angled cast walls for stress reduction is shown. The angles may vary in size and location within the cylinder head. The variation of location and size of the angled cast walls allow for a controlled path to dissipate high (i.e., 3200 psi) peak cylinder pressure loading. For example, the angled walls may be inclined from the inner face of the combustion face of the combined head and cylinder component 405 through a number of water jackets for loading control. In some embodiments, the combined head and cylinder component 405 includes an inclined middle deck above a combustion deck to take the load from the combustion deck center to the side walls.

FIG. 4 also shows the placement of water jackets to further control temperatures in portions of the engine. The water jackets may receive coolant to decrease the engine temperatures in various components. For example, a water jacket located near the valve seat 225 may decrease the engine temperature at the valve seat 225. A water jacket may also run over an exhaust port to cool the exhaust, or a hollow air pocket may run over the exhaust port without receiving coolant.

In some embodiments, the combined head and cylinder component 405 employs a 3-tier water jacket system to improve valve bridge cooling. The three tier water jacket system includes an upper water jacket, a middle water jacket, and a lower water jacket. The lower water jacket connects to the lower coolant rail-in, which is connected to a water pump. A plurality of coolant rail-in devices may be used, including a coolant rail in for each water jacket. Additionally, a plurality of water pumps may be used and connectively coupled to various coolant rail-in devices. The water jackets may also be placed in several areas on the engine. For example, a water jacket may be placed on the exhaust side of the engine or at the cylinder head.

Figure 5:
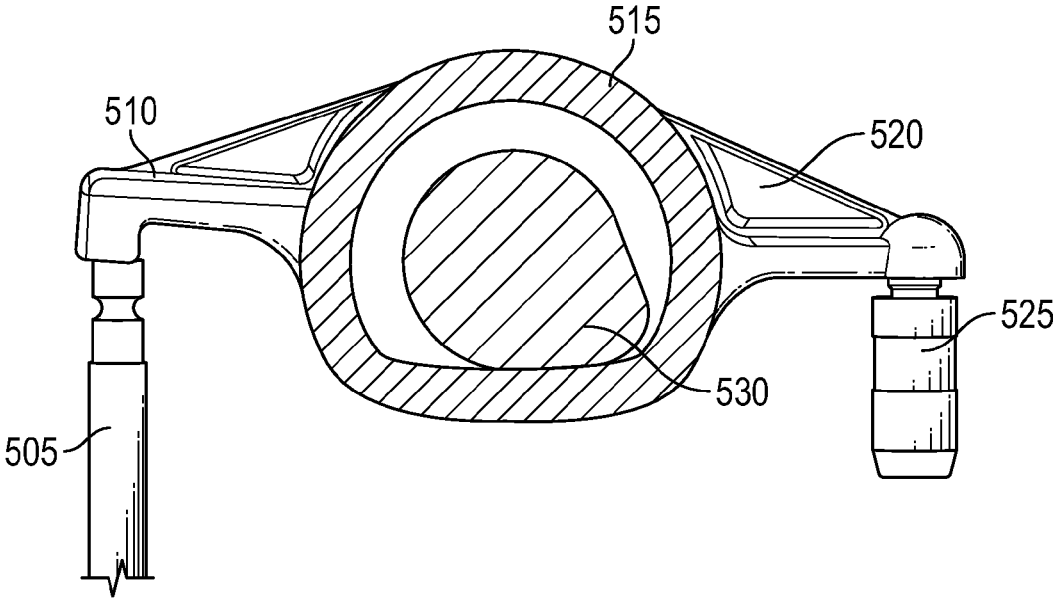
FIG. 5 is a schematic view of a cam rocker lever constructed according to various embodiments.

FIG. 5 is a schematic view of a cam rocker lever 500. In some embodiments, a cam rocker lever 500 is used to open and close the valve 125 in the valve cartridge 105. The cam rocker lever comprises an annular piece 515, a first arm 510 (i.e., first linear portion), a second arm 520 (i.e., a second linear portion), and a cam lobe. The annular piece 515 has an inner surface with an inner diameter and an outer surface with an outer diameter. The first arm 510 extends from one side of the outer surface of the annular piece 515, and the second arm 520 extends from an opposite side of the annular piece 515. In some embodiments, the first arm 510 is equal in length to the second arm 520. In other embodiments, the first arm 510 is greater in length than the second arm 520, or the first arm 510 is shorter than the second arm 520. The first arm 510 is configured to attach to the stem of a valve 125 to facilitate the movement of the valve 125. The cam rocker lever 500 may be anchored to a surface, such as a camshaft gear, by way of a connector 525 configured to attach to the end of the second arm 520 of a cam rocker lever 500.

The annular piece 515 of the cam rocker lever 500 has a cam lobe 530 is disposed within the inner diameter of the annular piece 515. The cam lobe 530 is an annular object with an annular protrusion that is configured to rotate within the inner surface of the annular piece 515. As the cam lobe 530 rotates, portions of cam lobe contact the annual piece generating actuation force at intervals, which causes the annular piece 515 to rock and displace the first arm 510. The valve 125, which is connected to the first arm 510, is displaced relative to the displacement of the first arm 510. This displacement caused by the rotation of the cam lobe 530 facilitates the opening and closing of the valve 125. This embodiment may increase the valve area opening up to 18%. In some embodiments, the cam lobe 530 is connected to a camshaft, which facilitates the rotation of the cam lobe 530. A plurality of cam lobes 530 may be connected to the camshaft. In some embodiments, hydraulic control of the inner cam lobe enables valve phasing capabilities. According to other embodiments, a rocker shaft is eliminated from the operation of the cam rocker lever 500.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principals of the invention and its practical application to enable one skilled in the art to utilize the invention in various embodiments and with various modifications as are suited to the particular use contemplated. Other substitutions, modifications, changes and omissions may be made in the disclosure's operating conditions and arrangement of the embodiments without departing from the scope of the present invention.

What is claimed is:

1. A cam rocker lever comprising:
an annular piece with an inner diameter;
a cam lobe disposed within the inner diameter of the annular piece;
a first linear portion extending from a first side of the annular piece; and
a second linear portion extending from a second side of the annular piece opposite the first side, wherein the first linear portion is configured to connect to a stem of a valve such that the valve is displaced when the first linear portion is displaced.

2. The cam rocker lever of claim 1, wherein the cam lobe is configured to rotate within the annular piece and contact an inner surface of the annular piece, the rotation of the cam lobe causing the first linear portion to displace relative to the valve to open the valve.

3. The cam rocker lever of claim 1, wherein a longitudinal length of the first linear portion is different than a longitudinal length of the second linear portion.

4. The cam rocker lever of claim 1, wherein a longitudinal length of the first linear portion is equal to a longitudinal length of the second linear portion.

5. The cam rocker lever of claim 1, further comprising:
a connector coupled to an end of the second linear portion, the connector anchoring the cam rocker lever to a surface.

6. The cam rocker lever of claim 5, wherein the surface includes a camshaft gear.

7. The cam rocker lever of claim 1, wherein the cam lobe is coupled to a cam shaft, the cam shaft facilitating rotation of the cam lobe.

8. An apparatus, comprising:
an internal combustion engine, including:
a piston positioned within a cylinder; and
at least one opening defined on a sidewall of the cylinder;
a valve operatively coupled to the opening, the valve including a valve stem positioned distal from the opening and a valve head positioned proximal to the opening; and
cam rocker lever operatively coupled to the valve, the cam rocker lever including:
an annular piece with an inner diameter;
a cam lobe disposed within the inner diameter of the annular piece;
a first linear portion extending from a first side of the annular piece; and
a second linear portion extending from a second side of the annular piece opposite the first side, wherein the first linear portion is communicatively coupled to a stem of the valve such that the valve is displaced when the first linear portion is displaced.

9. The apparatus of claim 8, wherein the cam lobe is configured to rotate within the annular piece and contact an inner surface of the annular piece, the rotation of the cam lobe causing the first linear portion to displace relative to the valve to move the valve head distal to the opening so as to allow fluid communication through the opening.

10. The apparatus of claim 9, wherein a valve spring is communicatively connected to the valve, the valve spring configured to urge the valve head towards the opening so as to prevent fluid communication through the opening.

11. The apparatus of claim 8, wherein a longitudinal length of the first linear portion is different than a longitudinal length of the second linear portion.

12. The apparatus of claim 8, wherein a longitudinal length of the first linear portion is equal to a longitudinal length of the second linear portion.

13. The apparatus of claim 8, further comprising:

a connector coupled to an end of the second linear portion, the connector anchoring the cam rocker lever to the sidewall of the engine.

14. The apparatus of claim 8, wherein the cam lobe is coupled to a cam shaft, the cam shaft facilitating rotation of the cam lobe.

* * * * *